United States Patent [19]

Teng et al.

[11] 4,307,733

[45] Dec. 29, 1981

[54] PROCESS FOR THE TREATMENT OF TOBACCO MATERIALS

[75] Inventors: Daniel M. Teng; Bernard A. Semp, both of Richmond, Va.

[73] Assignee: Philip Morris, Inc., New York, N.Y.

[21] Appl. No.: 104,202

[22] Filed: Dec. 17, 1979

Related U.S. Application Data

[63] Continuation-in-part of Ser. No. 944,226, Sep. 20, 1978, abandoned.

[51] Int. Cl.[3] ..... A24B 3/18

[52] U.S. Cl. ..... 131/293

[58] Field of Search ..... 131/140 R, 140 B, 142, 131/143, 144, 145, 141, 140 P

*Primary Examiner*—V. Millin

*Attorney, Agent, or Firm*—Arthur I. Palmer, Jr.

[57] ABSTRACT

This invention relates to a process for the treatment of tobacco materials. More particularly, the invention relates to a process that comprises contacting tobacco with an aqueous enzyme solution exhibiting cellulase activity, incubating the tobacco-enzyme mixture, and thereafter expanding the tobacco material. Tobacco materials treated in this manner exhibit an enhanced capability for expansion, thereby resulting in a significant increase in filling capacity when compared to untreated expanded tobacco.

6 Claims, No Drawings

PROCESS FOR THE TREATMENT OF TOBACCO MATERIALS

This is a continuation-in-part of U.S. Ser. No. 944,226 filed Sept. 20, 1978 now abandoned.

BACKGROUND OF THE INVENTION

The use of expanded tobacco materials in smoking products has escalated in recent years for a variety of reasons. For example expanded tobacco comprises an important part of the blend of tobaccos used to produce smoking products and particularly low delivery smoking products. Cost reduction is also realized when expanded tobacco is utilized in that less tobacco is required. A number of tobacco expansion techniques have been described in patents and/or published patent applications in recent years, and these techniques are suitable for use in practicing the present invention.

We have found that enzymatic treatment of tobacco materials, especially tobacco leaf, strip, cut filler, or stem, results in a significant increase in the expandability of the tobacco. Tobacco materials that are treated according to the enzymatic process of the present invention may then be subjected to known expansion techniques thereby resulting in a significantly increased filling capacity when compared to untreated tobacco.

Enzymatic modification of tobacco materials has been suggested by others. For example, U.S. Pat. Nos. 3,256,888 and 3,256,889 disclose the treatment of tobacco with proteolytic or peptidic enzymes whereby the flavor and smoking characteristics are improved. U.S. Pat. No. 3,240,214 discloses a method for making an improved reconstituted tobacco sheet wherein the tobacco components are treated with catalytic amounts of an enzyme system consisting of cellulase, hemicellulase, and pectinase. The resulting sheet product has increased tensile strength and elasticity. U.S. Pat. No. 3,974,838 discloses the treatment of tobacco with an amylolytic enzyme capable of converting the starch contained in the tobacco into sugar whereby the smoking properties are improved. U.S. Pat. No. 3,747,608 discloses the use of pectolytic enzymes produced by microorganisms for the purpose of effecting substantial fibrillation of plant parts, and particularly tobacco, thereby minimizing the need for mechanical beaters or homogenizers. The thus treated tobacco parts are then fabricated into reconstituted tobacco products.

U.S. Pat. No. 3,132,651 discloses the treatment of tobacco, preferably uncured, with cellulase to effect a relatively rapid aging or conditioning of the tobacco with a concomitant reduction in nicotine, phenols, and resins. The cellulase used is preferably of the Aspergillus type. The concentration of enzyme used is about 0.001 to 0.1% of the weight of the water, and generally excessive water is used in the range of 10 to 30 times the weight of the tobacco. After treatment for about ½ to 2 hours, the tobacco is drained, repeatedly rinsed with warm water, and dried under moderate heat. This process suffers several distinct disadvantages. The repeated washing of the tobacco with warm water results in an undesirably high loss of valuable tobacco solubles that contribute desirable flavorants to the tobacco when smoked. Secondly, because of the excessive amounts of water used during treatment, increased energy output is required to dry the tobacco to a moisture content suitable for use in smoking products.

U.S. Pat. No. 3,513,857 discloses a process for treating tobacco stems with a solution of polysaccharide-hydrolyzing enzymes exhibiting catalytic pectinase and hemicellulase activity whereby the stems become swollen and softened. The enzyme solution contains an enzyme to stem weight ratio of between about 1 to 10,000 and 1 to 10, and the concentration of water is about 50 to 1,000%, and preferably about 100 to about 400%, of the weight of the dry stems. Treatment times up to about 48 hours may be employed.

Although many of the enzyme preparations suggested for use contain cellulase as well as pectinase and hemicellulase, the inventor states at column 3, lines 12–15 of the specification that, "Pectinase, however, is the most essential of the enzymes as revealed by chemical analysis of the enzyme treated stems. Cellulase is the least essential of the enzymes." Treatment of stems according to this process results in a product having increased filling power, which may be further improved by freeze-drying. The degree of increased filling power was demonstrated by microscopic examination of the freeze-dried stems as well as by resistance to draw (RTD) measurements.

U.S. Pat. No. 3,425,425 discloses the use of carbohydrates to improve the puffing of tobacco stems. In this process, tobacco stems are impregnated with an aqueous solution comprising from 2 to 60 percent by weight of a carbohydrate. After impregnation, the stems are heated to effect expansion. The carbohydrate or sugar solution may also contain organic acids and/or certain salts which are used to improve the flavor and smoking qualities of the stems.

U.S. Pat. Nos. 3,612,065; 3,889,689; 3,943,945 and 4,013,082 disclose various methods for expanding tobacco materials wherein the tobacco is treated with catalase and hydrogen peroxde. Catalase is an enzyme which catalyzes the decomposition of hydrogen peroxide into water and oxygen gas. In U.S. Pat. No. 3,612,065 the inventor discusses the application to tobacco of common baker's-type yeast which apparently contains sufficient catalase enzyme to decompose the subsequently added hydrogen peroxide. In some instances, the yeast may be suspended in a sucrose solution and thereafter the solution is applied to the tobacco. The oxygen released by the addition of hydrogen peroxide to the catalase treated tobacco effects expansion of the tobacco. U.S. Pat. Nos. 3,889,689; 3,943,945 and 4,013,082 relate to improvements of the earlier disclosed expansion process.

SUMMARY OF THE INVENTION

The present invention provides an improved process for the enzymatic treatment of tobacco materials with an aqueous solution of cellulase, such as that produced by the microorganism *Trichoderma viride.* Following a suitable incubation period of the tobacco-enzyme mixture, the tobacco may be expanded by any of the known expansion techniques. Tobacco treated with cellulase prior to expansion exhibits an increased filling capacity or ability to expand when subjected to known expansion techniques.

DESCRIPTION OF PREFERRED EMBODIMENTS

The process of the present invention may be adapted for use on green, dried, partially cured, or cured tobacco or homogenized leaf cure tobacco. By tobacco is meant tobacco leaf, strip, stem, midribs, stalk, reconstituted tobacco sheet, or any combination thereof. Use of cellulase produced by microorganisms such as *Aspergillus niger, Cellulomonas* sp., *Myrothecium verrucaria, Penicillium expansum,* and various strains of *Trichoderma viride* such as ATCC 13631, 24449, 26920, and 26921 is possible; however, we have found that using cellulase produced by *Trichoderma viride* results in highly satisfactory enhanced expandability of the tobacco. *Trichoderma (viride) longibrachiatum* QM 9414 (ATCC 26921) was purchased from the American Type Culture Collection, Rockville, Maryland 20852. Procedures used for the preparation of cellulase are disclosed generally by Mandels and Sternberg in "Recent Advances in Cellulase Technology," *Journal of Fermentation Technology,* 54(4), 1976, pages 267–286. The procedures will be described in detail hereinafter.

Tobacco, preferably in strip or shredded form, is sprayed with a solution of cellulase so as to provide about 50 to 2,000 units, and preferably about 200 to 1,000 units of *Trichoderma viride* (Tv) cellulase activity per kilogram of tobacco. Cellulase activity is determined generally by two assays wherein $C_l$ and $C_x$ activity are measured in terms of glucose production. Both assays will be described in detail hereinafter. $C_x$ activity is generally determined by measuring the degree of hydrolysis of carboxymethylcellulose (CMC) by cellulase. The reducing sugars formed are measured as glucose. $C_l$ activity is measured by a similar method wherein a microcrystalline form of cellulose such as Avicel TM is subjected to enzymatic hydrolysis using cellulase. Glucose and/or total reducing sugars resulting therefrom may be measured as before. The units of enzyme activity equal milligrams of glucose produced per milliliter of enzyme solution; Tv cellulase activity equals $C_l+C_x$ activities.

Only enough solution is utilized to assure even distribution of the enzyme throughout the tobacco thereby minimizing energy output in drying the materials after treatment. Typical methods for applying the cellulase to the tobacco materials include spraying, dipping, or passing the tobacco through a bath containing the enzyme solution. Following application of the enzyme solution, the tobacco typically has a moisture content of about 20 to 50% by weight. The pH of the tobacco-enzyme system is maintained in a range between about 3.5 and 6.5, and optimally at about 4.8 by use of citrate buffer. After contacting the tobacco materials with the enzyme solution, the tobacco is placed in a container and incubated at a temperature in the range of about 35° to 70° C., and preferably at about 50° C., for a period of about 4 to 124 hours.

Following incubation, the tobacco may be dried to a moisture content in the range of 10 to 25% by weight, using any suitable means and equilibrated at about 23.9° C. and 60% relative humidity (r/h). The tobacco is then expanded using known expansion techniques such as those disclosed in Canadian Pat. No. 1,013,640.

When tobacco stems are to be expanded, the expansion techniques as disclosed in U.S. Pat. No. 3,734,104 to Buchanan and Madures produce satisfactory results. In most instances it will not be necessary to extensively dry the tobacco stems in that satisfactory expansion is achieved when the moisture content of the stems is in the range of 24 to 60% by weight, and preferably at about 40 to 60% moisture by weight. Following expansion and reequilibration, the tobacco is ready for use in fabricating cigarettes wherein expanded tobacco comprises a part of the total blend. Tobacco materials treated according to the present invention exhibit exhanced expandability thereby resulting in an increased filling capacity of about 10 to 30% as compared to expanded tobacco that has not been pretreated with cellulase.

It will be readily apparent to those skilled in the art that various modifications of the process are possible. For example, for commercial production purposes, shorter reaction times may be required and this may be achieved generally by using either cellulase of increased concentration or cellulase with increased activity; i.e., greater than 1,000 units of Tv cellulase activity per kilogram of tobacco. The enzyme-containing broths as produced herein may be concentrated by known methods in the art, such as freeze-drying or protein precipitation techniques. In this instance, the concentrated enzyme is resuspended in a suitable buffered solution to the desired range of activity and thereafter applied to the tobacco materials. Where time requirements are not of great concern, the more dilute enzyme broth has been found to be adequate to achieve the desired results. Various other modifications may be made and are considered to be within the spirit and scope of the present invention.

EXAMPLE 1

Cellulase Preparation

A. Induction Broth—The cellulase-containing broth was prepared as described hereinbelow.

The Trichoderma viride medium for cellulase production was prepared according to the following formulation (grams/liter):

| | | | |
|---|---|---|---|
| $(NH_4)_2SO_4$ | 1.4 | $FeSO_4 . 7H_2O$ | 0.0050 |
| $KH_2PO_4$ | 2.0 | $MnSO_4 . H_2O$ | 0.0016 |
| Urea | 0.3 | $ZnSO_4 . 7H_2O$ | 0.0014 |
| $CaCl_2$ | 0.3 | $CoCl_2$ | 0.0020 |
| $MgSO_4 . 7H_2O$ | 0.3 | | |
| Cellulose (Avicel PH-105, FMC Corporation) | | | 10.0 |
| Protease peptone (Difco) | | | 1.0 |
| Tween ® 80 | | | 2.0 |
| pH | | | 5.0–6.0 |

The broth was divided into 250 ml aliquots and placed in 1-liter creased shake flasks. The flasks were capped (metal) and sterilized for 25 minutes at 121° C. and 15 psi.

B. Inocula Preparation—A potato dextrose agar (Difco) slant was inoculated with 0.05 ml of a sterile water solution containing spores of *Trichoderma (viride) longibrachiatum* QM 9414 (ATCC 26921). This material was spread with a sterile loop, the tube sealed (screw cap), and incubated for 96 hours at 24°±1° C. At this point, the material may be stored at 0° to 5° C. until further usage is desired. Transfer of cultures of *Trichoderma viride* every 21 days gives satisfactory results.

If immediate usage is desired, the slants are removed from the incubator and three milliliters of sterile water is introduced. The slant is then shaken (Vortex Genie Mixer, Scientific Products) for 1 minute.

The suspension from the slant is asceptically transferred to a 500 ml creased flask containing 100 ml of potato dextrose broth (Difco), capped, and placed in New Brunswick Scientific gyrotory® water bath shaker set at 24°±1° C. This material is shaken at 80 RPM, for 96 hours at which time it is removed and placed in a refrigerator at 0° to 5° C. for at least 12 but no longer than 48 hours prior to usage. This material will be referred to hereinafter as the seed broth.

C. Induction—Four milliliters of seed broth were transferred to the flasks containing 250 ml of cellulase induction broth as prepared in Step (A). The flasks were then placed in a New Brunswick Scientific gyrotory ® water bath shaker and incubated at 60 RPM, 24°±1° C. for 13 days.

D. Fungal Removal—The Trichoderma viride-containing broth was removed from the shaker and quickly chilled in an ice bath. The chilled broth was centrifuged at 12,000 g for 30 minutes in a refrigerated centrifuge (Beckman Model J-21C). The supernatant broth was then passed through a 0.2μ milipore filter, poured into sterile flasks packed in ice, and stored in a refrigerator at 0° to 5° C. This cellulase-containing culture broth was then ready for enzyme assays.

E. Enzyme Assays—In order to determine the specific enzyme activity of the materials prepared in Steps (C) and (D), assays as generally disclosed by Mandels et al. in *Biotechnology and Bioengineering,* Volume XVI, pages 1471-93, 1974 were used. See specifically page 1473 of the article.

Assay 1: $C_x$ Activity—One half of a ml of the enzyme solution obtained in Step (D) is added to 0.5 ml of a 1% solution of carboxymethylcellulose (CMC) having a degree of substitution of 0.5 in 0.1 M citrate buffer, pH 4.8. The mixture is incubated at 50° C. for 60 minutes. Three ml of dinitrosalicylic acid, hereinafter DNS, is added and the mixture is boiled for 5 minutes. Eight ml of water is added to the mixture and the optical density is read at 550 mμ on a spectrophotometer (Hitachi Model 124). Units of activity=mg glucose produced/ml of enzyme solution.

Assay 2: $C_l$ Activity—To 5 ml of the enzyme solution obtained in Step (D) is added 250 mg Avicel PH 105 and the mixture is adjusted to pH 4.8 using 0.1 M citrate buffer, pH 4.8. The mixture is incubated at 50° C. for 24 hours and then filtered. To one ml of the filtrate is added 3 ml of DNS. The mixture is boiled for 5 minutes, diluted with 8 ml of water and the optical density is read at 550 mμ on a spectrophotometer. Units of enzyme activity=mg glucose produced/ml of enzyme solution. Tv cellulase activity=$C_x+C_l$ activity.

Assay 3: Protein Measurement—Lowry's Folin phenol reagent method is used to determine the protein content in the enzyme broth. (*Journal of Biological Chemistry,* Volume 193, pages 265-275, 1951.)

EXAMPLE 2

One kg of bright tobacco cut filler was sprayed with 300 ml of 0.5 M citric-sodium citrate buffer at pH 4.8 containing 750 units of total Tv cellulase activity ($C_l+C_x$ activity) as prepared in Example 1(D). The tobacco was placed in a container and incubated at 50° C. for 72 hours. The treated tobacco material was then air-dried and equilibrated at about 23.9° C. and 60% r/h. This material was then expanded using the process as disclosed in Canadian Pat. No. 1,013,640. The expanded material was equilibrated at 23.9° C. and 60% r/h, and the filling capacity was determined by the cylinder volume determination of Wakeham et al. as disclosed in *Tobacco Science,* Volume XX (1976), pages 157-160. One kg of bright tobacco cut filler, which was sprayed with 300 ml of 0.5 M citric-sodium citrate buffer at pH 4.8 and treated as described above, was used as a control.

The average results comprised of three separate runs, (8 replicates) are listed below.

| | Control | Cellulase-Treated |
|---|---|---|
| Cylinder Volume (cc/10g) | 83.4 | 99.4 |

The increased filling capacity of the cellulase-treated tobacco samples ranged from about 12% to a high of about 29% with an average of about 19.1% when compared to expanded tobacco samples that had not been treated with cellulase. Enhanced expandability of cellulase-treated tobacco is evident from the above results.

EXAMPLE 3

In a similar manner to Example 2, one kg of bright tobacco filler was sprayed with 300 ml of 0.5 M citric-sodium citrate buffer at pH 4.8, which contained 375 units of total cellulase activity. The tobacco was placed in a container and incubated at 50° C. for 72 hours. The treated tobacco material was then air-dried and equilibrated at 23.9° C. and 60% r/h. The equilibrated tobacco filler was expanded as in Example 2 and equilibrated as before. The cylinder volume was determined using the method of Wakeham et al. One kg of tobacco filler, which was sprayed with 300 ml of 0.5 M citric-sodium citrate buffer at pH 4.8 and treated as described above, was used as a control. The results are tabulated below.

| | Control | Cellulase-Treated |
|---|---|---|
| Cylinder Volume (cc/10 g) | 75.9 | 85.9 |

The results show that the enzyme-treated filler expanded to a greater degree; i.e., 13.2% greater than the untreated control tobacco.

EXAMPLE 4

In a similar manner to Example 2, 1 kg of tobacco stems was sprayed with 300 ml of a solution of 0.5 M citrate-sodium citrate buffer at pH 4.8. The solution contained 750 units of total cellulase activity ($C_l+C_x$=total activity). The enzyme-stem mixture was incubated for 12 hours at 50° C. Control stems were sprayed with the same buffer solution containing no cellulase and treated in a similar manner. The enzyme-treated stems and control stems were expanded according to the methods disclosed in U.S. Pat. No. 3,734,104 to Buchanan and Madures. Following equilibration at 23.9° C. and 60 r/h, the filling capacity of the expanded stems was determined using the cylinder volume method. The results are tabulated below.

| | Control | Cellulase-Treated |
|---|---|---|
| Cylinder Volume (cc/10g) | 39.5 | 43.0 |

The results indicate that the cellulase-treated stems expanded to a greater degree, specifically 8.9% greater, than the untreated expanded control.

EXAMPLE 5

To demonstrate that the expansion enhancement is predominantly a function of the cellulase enzyme, tobacco filler was treated with pectinase, hemicellulase, and pectinesterase purchased from Sigma Chemical Company. One kg of tobacco filler was treated with 300 ml of appropriate buffer, which contained 1 g of the designated enzyme. The tobacco-enzyme mixture was incubated at the specified optimum temperature for the particular enzyme for 24 hours. Following prolonged incubation at the designated temperature range and moisture content, some degree of spoilage was noted. The enzyme-treated tobacco and control tobacco treated in a similar manner were dried, equilibrated, and expanded as in Example 2. The experimental conditions and results are tabulated below.

| | pH | Temperature °C. | Enzyme Activity units/mg | Cylinder Volume (cc/10 g) Control | Treated |
|---|---|---|---|---|---|
| Pectinase | 4.0 | 25 | 0.9 | 108.2 | 106.0 |
| Hemicellulase | 5.5 | 37 | 1.0 | 87.7 | 87.7 |
| Pectinesterase | 7.5 | 30 | 22 | 82.6 | 82.0 |

The results indicate that there is no significant change in the cylinder volume when tobacco is treated with the above-cited enzymes and then expanded using the method disclosed in Canadian Pat. No. 1,013,640.

EXAMPLE 6

To demonstrate the use of the present invention in a typical tobacco production run, the cellulase enzyme produced by *Trichoderma viride* was incorporated into the casing solution and applied to the tobacco. The casing solution, which is comprised of a mixture of hygoscopic agents and volatile or nonvolatile flavoring agents is generally sprayed on the tobacco to condition it for further processing.

One kg of tobacco filler was sprayed with a buffered solution containing 750 units of total cellulase activity and tobacco casing additives. Control tobacco was sprayed with a similar buffered casing solution containing no cellulase.

The treated tobacco and control were incubated for 72 hours at 50° C. and then expanded and equilibrated as in Example 2. The cylinder volume of the treated and control tobacco were determined and the results are tabulated below.

| | Control | Cellulase-Treated |
|---|---|---|
| Cylinder Volume (cc/10g) | 77.6 | 101.8 |

The cellulase-treated tobacco increased 31.2% more in volume than the untreated control tobacco.

What is claimed is:

1. A process for treating tobacco material to achieve increased filling power that comprises the steps of:
   a. contacting tobacco material with a buffered solution having a pH in the range of about 3.5 to 6.5 and containing cellulase enzyme in an amount sufficient to provide 50 to 2,000 units of cellulase activity ($C_l+C_x$) per kilogram of tobacco;
   b. incubating the tobacco-cellulase mixture for a period of time between 4 and 124 hours and at a temperature within the range of 35° to 70° C.; and
   c. expanding the cellulase-treated tobacco materials thereby resulting in increased filling power compared to the untreated expanded tobacco material.

2. The process of claim 1 wherein the buffered solution of cellulase enzyme contains about 200 to 1,000 units of cellulase activity ($C_l+C_x$) per kilogram of tobacco.

3. The process of claim 1 wherein the tobacco material is selected from stem, strip, midribs, cut filler, or reconstituted tobacco individually or in any combination thereof.

4. The process of claim 1 wherein the cellulase used is produced by the microorganism *Trichoderma viride.*

5. The process of claim 1 wherein the cellulase-treated tobacco of Step(b) has a moisture content in the range of about 20 to about 50% by weight.

6. The process of claim 1 wherein the tobacco material comprises cut filler, said filler being dried to a moisture content in the range of 10 to 25% by weight prior to the expansion step.

* * * * *